US008435050B2

(12) United States Patent
Tziviskos et al.

(10) Patent No.: US 8,435,050 B2
(45) Date of Patent: May 7, 2013

(54) USB CONNECTOR HAVING VERTICAL TO HORIZONTAL CONVERSION CONTACTS

(75) Inventors: George Tziviskos, Cupertino, CA (US); Gregory A. Springer, Sunnyvale, CA (US); Zheng Gao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/093,824

(22) Filed: Apr. 25, 2011

(65) Prior Publication Data

US 2012/0270448 A1 Oct. 25, 2012

(51) Int. Cl.
*H01R 12/00* (2006.01)

(52) U.S. Cl.
USPC ..... 439/79; 439/736; 439/686

(58) Field of Classification Search ..... 439/79, 439/736, 686, 695, 701
See application file for complete search history.

(56) References Cited

U.S. PATENT DOCUMENTS

| | | | | |
|---|---|---|---|---|
| 5,910,347 | A * | 6/1999 | Pauza | 428/36.9 |
| 6,004,160 | A * | 12/1999 | Korsunsky et al. | 439/660 |
| 6,200,171 | B1 * | 3/2001 | Fusselman et al. | 439/736 |
| 6,371,817 | B1 | 4/2002 | Shi et al. | |
| 7,452,247 | B1 * | 11/2008 | Rahman et al. | 439/736 |
| 7,618,298 | B2 * | 11/2009 | Rahman et al. | 439/736 |
| 7,980,895 | B2 * | 7/2011 | Berens et al. | 439/607.05 |
| 2011/0076883 | A1 | 3/2011 | Jol | |
| 2012/0270447 | A1 | 10/2012 | Blakborn et al. | |

FOREIGN PATENT DOCUMENTS

| | | | |
|---|---|---|---|
| DE | 20 2009 015 286 | U1 | 2/2010 |
| EP | 1 971 003 | A1 | 9/2008 |
| JP | 2005-242448 | A | 9/2005 |

OTHER PUBLICATIONS

Invitation to Pay Additional Fees mailed on Aug. 2, 2012 for PCT Patent Application No. PCT/US2012/034829, 5 pages.
International Search Report mailed on Oct. 1, 2012 for PCT Patent Application No. PCT/US2012/034829, 8 pages.
Written Opinion of the International Searching Authority mailed on Oct. 1, 2012 for PCT Patent Application No. PCT/US2012/034829, 10 pages.

* cited by examiner

*Primary Examiner* — Gary F. Paumen
(74) *Attorney, Agent, or Firm* — Kilpatrick Townsend & Stockton LLP

(57) ABSTRACT

Connector receptacles that provide a right-angle translation, may be readily manufactured, and may have an aesthetically pleasing appearance. One example may provide a connector receptacle having contacts that provide a right-angle translation. Another example may provide a connector receptacle having an aesthetically pleasing appearance. By inserting an injection molded housing into an over-mold, the interior of a connector may appear to be formed from a single piece of plastic or other material.

20 Claims, 10 Drawing Sheets

USB CONNECTOR HAVING VERTICAL TO HORIZONTAL CONVERSION CONTACTS

BACKGROUND

Electronic devices have become ubiquitous the past several years. The number and types of portable computing devices, tablet, desktop, and all-in-one computers, cell, smart, and media phones, storage devices, portable media players, navigation systems, monitors and other devices has increased tremendously and this increase shows no signs of abating.

These electronic devices often share power and data between each other using a cable. These cables often have a connector plug on each end that mates with connector receptacles on the electronic devices. These receptacles may have various orientations depending on the practicalities and aesthetics of the device. For example, a laptop computer may have a relatively long, thin side. Receptacles for such a laptop may be arranged in a primarily horizontal manner along its side. Receptacles for other devices may provide an improved appearance or may simplify use if they are placed vertically in the device.

Connector receptacles are typically attached to boards inside a device. These boards may be main logic or motherboards, daughter boards, or other types of boards. These boards may be printed circuit boards, flexible circuit boards, or other appropriate substrates.

In various devices, these receptacles and boards may have the same or different orientations. Often, a receptacle and an associated board may have the same orientation. In these cases, contacts in the receptacle can emerge from the receptacle in a direct manner. In other situations, a receptacle and a board may be at right angles, or may be tilted or angled in other ways. This may necessitate an additional board or other device to provide an angle translation.

Also, for many devices, appearance of the device and its constituent parts may be a selling feature. Moreover, it is often desirable to be able to easily manufacture these connector receptacles.

Thus, what is needed are connector receptacles that may provide an angle translation, a pleasing aesthetic appearance, and be readily manufacturable.

SUMMARY

Accordingly, embodiments of the present invention may provide connector receptacles that may provide a right-angle translation, may be readily manufactured, and may have an aesthetically pleasing appearance.

An illustrative embodiment of the present invention may provide a connector receptacle having contacts that provide a right-angle translation. This connector receptacle may be readily manufactured. A specific embodiment of the present invention may provide contacts attached to a carrier. These contacts may be stamped from a sheet of metal or other conductive material, then formed into three-dimensional shapes. The formed contacts may be secured using an injection-molded housing. The contact and injection molded housing portion may be inserted into an over-mold. The injection molded housing and over-mold may be fixed to each other, for example, by snapping or otherwise joining the injection molded housing and over-mold together, or by using an adhesive, or both. The over-mold may include fingers, or fingers may be added after the over-mold and housing are attached. A shield may be placed to substantially cover the over-mold and housing.

An illustrative embodiment of the present invention may provide a connector receptacle having an aesthetically pleasing appearance. Specifically, by inserting an injection-molded housing into an over-mold, the interior of a connector may appear to be formed from a single piece of plastic or other material.

An illustrative embodiment of the present invention may provide a connector receptacle that provides a right-angle translation in a space-efficient manner. In a specific embodiment of the present invention, a first contact may extend a first length in an X direction and a second length in a Z direction, a second contact may extend the first length in the X direction and the second length in the Z direction, and a third contact may extend the first length in the X direction, a third length in the Z direction, a fourth length in a Y direction, and a fifth length in the Z direction. The third length plus the fifth length may be equal to the second length. A fourth contact may extend the first length in the X direction and the second length in the Z direction. All directions and lengths may be approximate and may vary due to manufacturing and other tolerances and errors.

Embodiments of the present invention may provide connector receptacles consistent with various standard and proprietary communication interfaces. For example, embodiments of the present invention may provide connector receptacles consistent with Universal Serial Bus (USB), High-Definition Multimedia Interface (HDMI), Digital Visual Interface (DVI), DisplayPort, Thunderbolt, and other types of interfaces.

Embodiments of the present invention may provide connector receptacles for use in many types of devices. For example, connector receptacles consistent with embodiments of the present invention may be employed in portable computing devices, tablet, desktop, and all-in-one computers, cell, smart, and media phones, storage devices, portable media players, navigation systems, monitors, and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
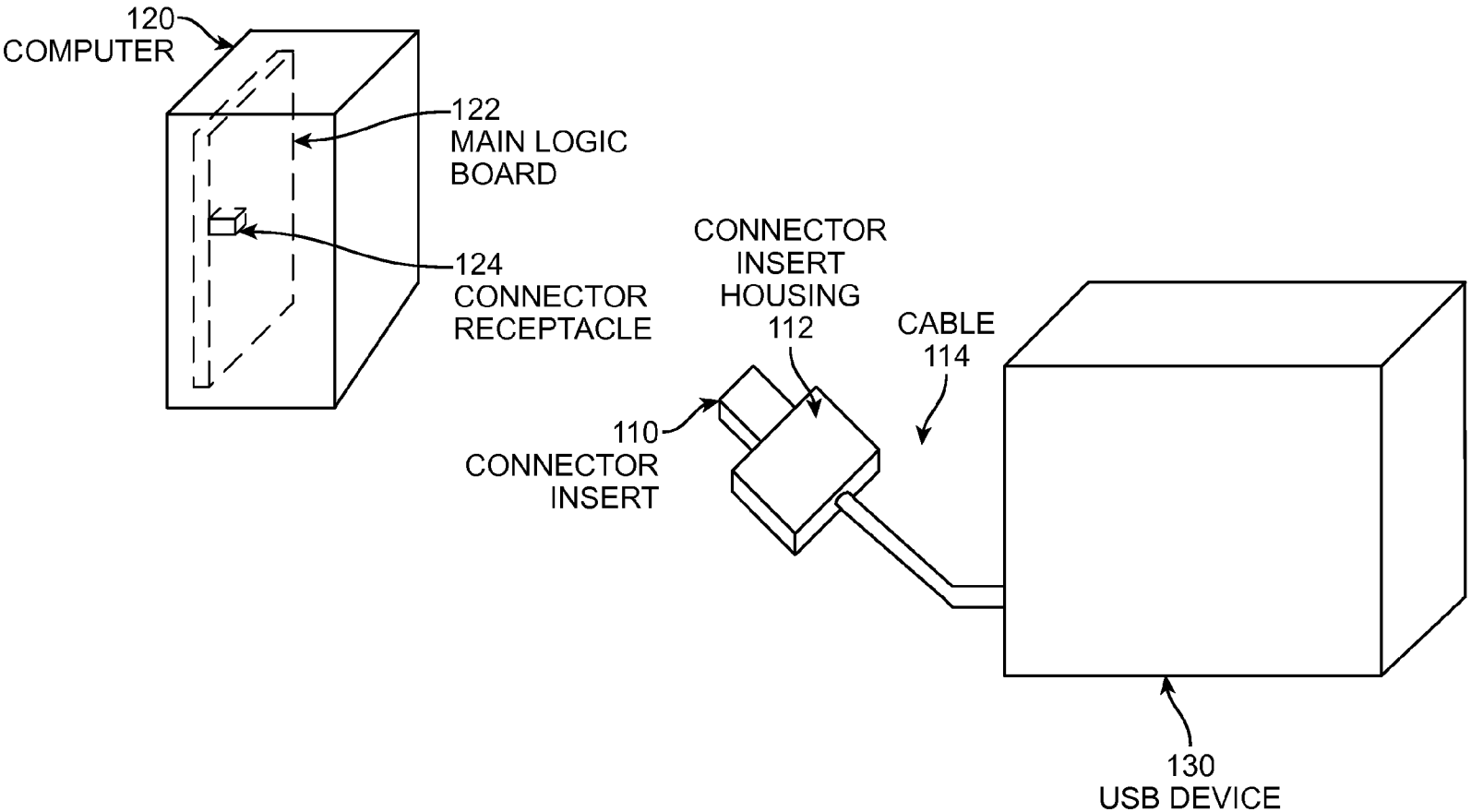
FIG. 1 illustrates an electronic system that may be improved by the incorporation of an embodiment of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This figure illustrates computer 120 that may communicate with USB device 130 over cable 114. Cable 114 may terminate in connector insert 110. Connector insert 110 may include connector insert housing 112. Connector insert housing 112 may be handled by a user during insertion of connector insert 110.

Connector insert 110 may be arranged to mate with connector receptacle 124 on computer 120. That is, contacts (not shown) in connector insert 110 may be arranged to form electrical connections with contacts (not shown) in the connector receptacle 124. Contacts in connector receptacle 124 may connect to main-logic board 122 in computer 120.

In this example, connector receptacle 124 is shown as being substantially horizontal, while main-logic board 122 is shown as being substantially vertical. Accordingly, contacts in connector receptacle 114 may have a first portion to mate with contacts in connector insert 110. The first portion may be in a direction out of the connector receptacle 124. These contacts may further have a portion angled to be able to connect to main-logic board 122. With this configuration, contacts in connector receptacle 124 may provide a 90-degree or right-angle translation.

While embodiments of the present invention are particularly useful for connector receptacles compliant with one or more of the various Universal Serial Bus standards, which are currently defined, or may be defined in the future, other embodiments of the present invention may provide connector receptacles for other types of interfaces. For example, embodiments of the present invention may provide connector receptacles for HDMI, DVI, DisplayPort, Thunderbolt, and other types of interfaces.

In this example connector receptacle 124 is shown as being attached to computer 120, though other connector receptacles consistent with embodiments of the present invention may be attached to other types of electronic devices, such as portable computing devices, tablet, desktop, and all-in-one computers, cell, smart, and media phones, storage devices, portable media players, navigation systems, monitors and other devices.

Also, while in this example connector receptacle 124 is shown as attaching to main-logic board 122, in other embodiments of the present invention, connector receptacle 124 may attach to other boards, cards, flexible circuit boards, or other appropriate substrates.

In various embodiments of the present invention, connector receptacle 124 may attach to main-logic board 122 in various ways. For example, connector receptacle 124 may provide surface mount contacts, which may be connected to traces on main-logic board 122. In other embodiments of the present invention, connector receptacle 124 may provide through-holes. Connector receptacle 124 may reside flush on main-logic board 122, or it may be placed on an edge of main-logic board 122. An example is shown in the following figure.

Figure 2:
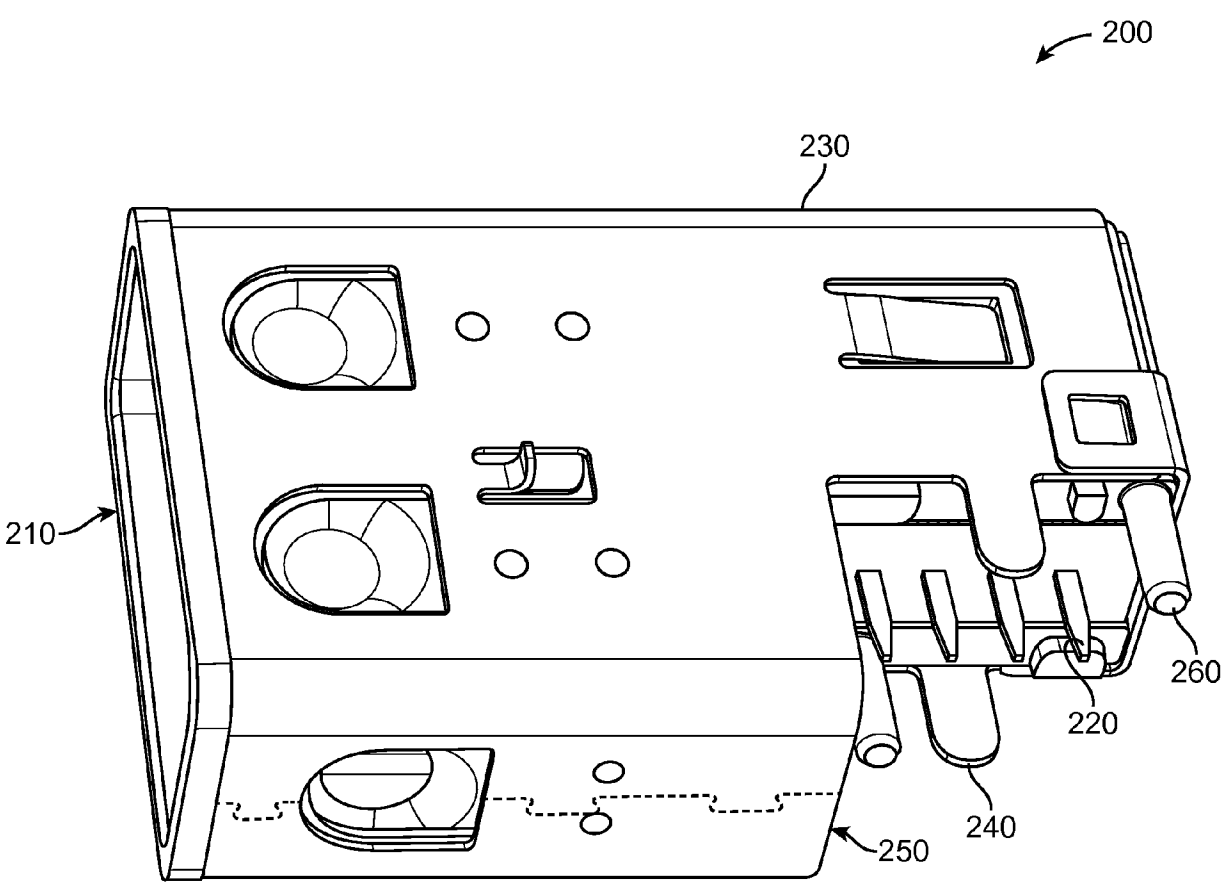
FIG. 2 illustrates a connector receptacle according to an embodiment of the present invention.

FIG. 2 illustrates a connector receptacle 200 according to an embodiment of the present invention. Connector receptacle 200 may be used as connector receptacle 124, or as other connector receptacles according to embodiments of the present invention. Connector receptacle 200 may include an opening 210 for accepting a connector insert. Contacts (not shown) in opening 210 may emerge as through-hole contacts 220. Through-hole contacts 220 may be soldered or otherwise fixed into corresponding holes in a main-logic board, motherboard, flexible circuit board, or other appropriate substrate. Connector 200 may be substantially surrounded by shield 230. Shield 230 may provide electromagnetic interference protection to circuitry inside, or nearby, an electronic device that includes connector receptacle 200 from signals on contacts in connector receptacle 200. Also, shield 230 may provide protection for signals on contacts in connector 200 from circuits inside, or nearby, the electronic device. Shield 230 may include one or more tabs 240. Tabs 240 may be soldered or otherwise fixed in corresponding openings in a main-logic board or other appropriate substrate.

Connector receptacle 200 may further include edge 250. Edge 250 may placed against a corresponding edge of a main-logic board or other appropriate substrate. Furthermore, connector 200 may include an internal housing having one or more posts 260. Posts 260 may be arranged to mate with through-holes in a main-logic board or other appropriate substrate. By using posts 260, connector receptacle 200 may be mechanically fixed to a main-logic board or other appropriate substrate in a secure fashion.

Specifically, edge 250 may be placed against an edge of a main-logic board or other appropriate substrate. As a connector insert is inserted into opening 210, the force of such insertion is distributed to the main-logic board or other appropriate substrate. Also, contacts 220, tabs 240, and posts 260 provide a secure attachment for the various parts of connector receptacle 200 to the main-logic board or other appropriate substrate.

Again, contacts in connector receptacle 200 may provide a right-angle transition. That is, contacts that are substantially horizontal near opening 210 of connector receptacle 200 may translate to substantially vertical contacts 220. An example of how this may be done in an efficient, space-saving manner is shown in the following figure.

Figure 3:
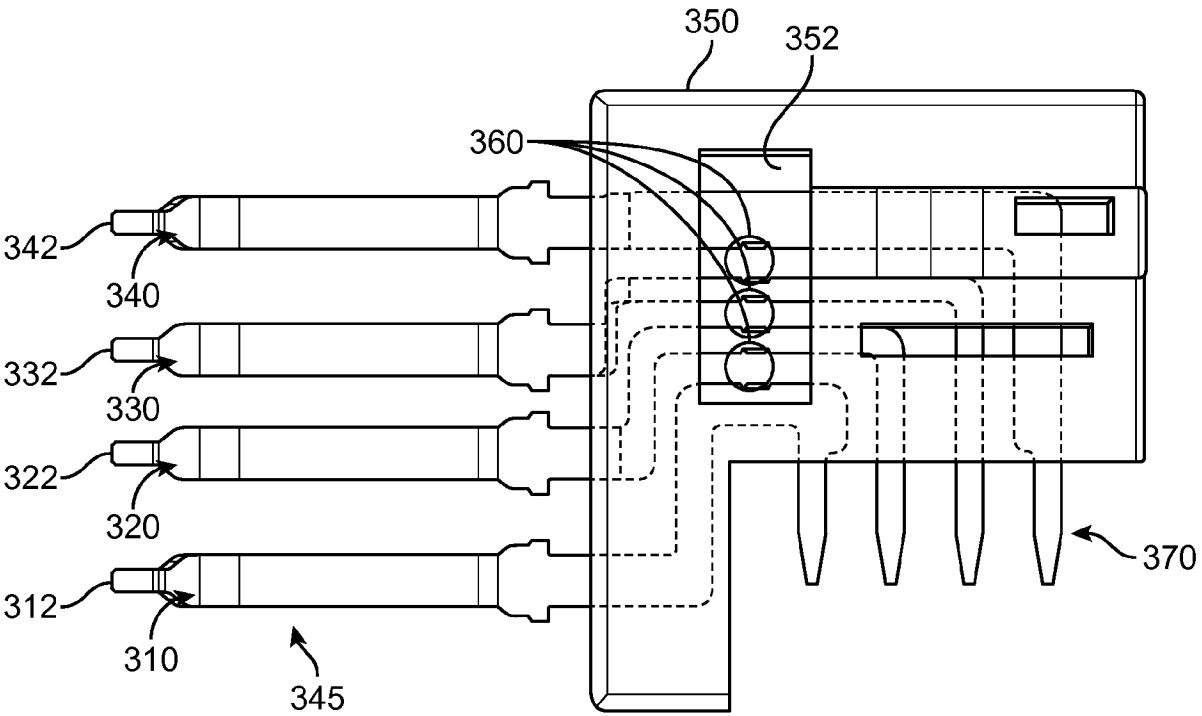
FIG. 3 illustrates a top view of contacts in a connector receptacle according to an embodiment of the present invention.

FIG. 3 illustrates a top view of contacts in a connector receptacle according to an embodiment of the present invention. This figure includes a first contact 310, second contact 320, third contact 330, and fourth contact 340. Contacts 310, 320, 330, and 340 include first portions 345 for mating with contacts in a connector insert. Contacts 310, 320, 330, 340, include tail portions 370, which may be soldered or otherwise connected to traces and through-holes in a main-logic board or other appropriate substrate.

FIG. 3 also illustrates first housing portion 350 surrounding a middle portion of the contacts 310, 320, 330, and 340. First housing portion 350 may be formed by injection molding. First housing portion 350 may include a window 352.

During assembly, contacts 310, 320, 330, and 340, may be attached at tips 312, 322, 332, and 342 to a carrier (not shown). Contacts 310, 320, 330, and 340 may also be connected to each other by bridges located at positions 360. Bridges at positions 360 may be removed using window 352. The carrier and bridges 360 may provide a group of contacts that is particularly easy to handle as a unit. By handling contacts 310, 320, 330, and 340 as a unit, manufacturing may be simplified, since these contacts may not have to be handled or inserted on an individual basis. Also during assembly, contacts 310, 320, 330, and 340 may be stamped then formed together as a unit. That is, they may be stamped from a sheet of metal or other conductive material. They may then be formed such that they are transformed from two dimensional or flat contacts to three-dimensional contacts as shown. First housing portion 350 may be injection-molded around a middle portion of contacts 310, 320, 330, and 340. After first housing portion 350 is injection-molded around a middle portion of contacts 310, 320, 330, and 340, the carrier and bridges 360 may be removed.

Again, contacts 310, 320, 330, and 340, may be arranged such that they provide a right-angle translation in a space-efficient manner. An example is shown in the following figure.

Figure 4:
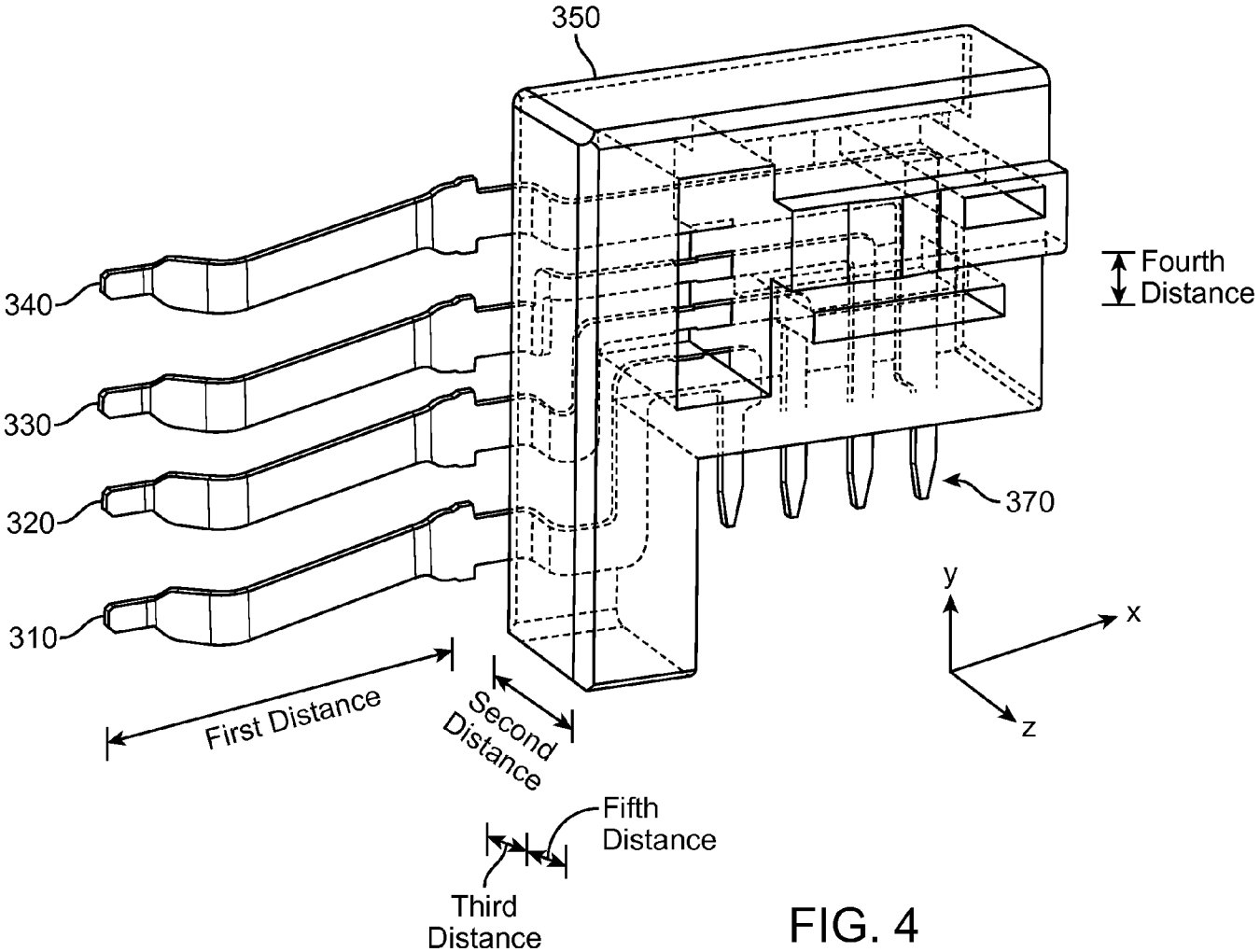
FIG. 4 illustrates an oblique view of contacts and a first housing portion according to an embodiment of the present invention.

FIG. 4 illustrates an oblique view of contacts 310, 320, 330, and 340, and first housing portion 350 according to an embodiment of the present invention. As can be seen, first contact 310 extends approximately a first distance in an X direction and approximately a second distance in a Z direction. Similarly, second contact 320 extends approximately a first distance in the X direction and a second distance in the Z direction. Third contact 330 extends approximately the first distance in the X direction, a third distance in the Z direction, a fourth distance in a Y direction, and a fifth distance in the Z direction. Fourth contact 340 extends approximately the first distance in the X direction and the second distance in the Z direction.

First contact 310, second contact 320, third contact 330, and fourth contact 340 may also route as shown to complete the right-angle translation. This further allows contact tips 370 to be spaced such that they may mate with through-holes in a main-logic board (that is, the through-holes in the main-logic board may not be too close to each other for reliable manufacturing).

By forming third contact 330 in this way, third contact 330 routes around second contact 320. This allows contacts 310, 320, 330, and 340, to provide a right angle translation in a space-efficient manner.

Figure 5:
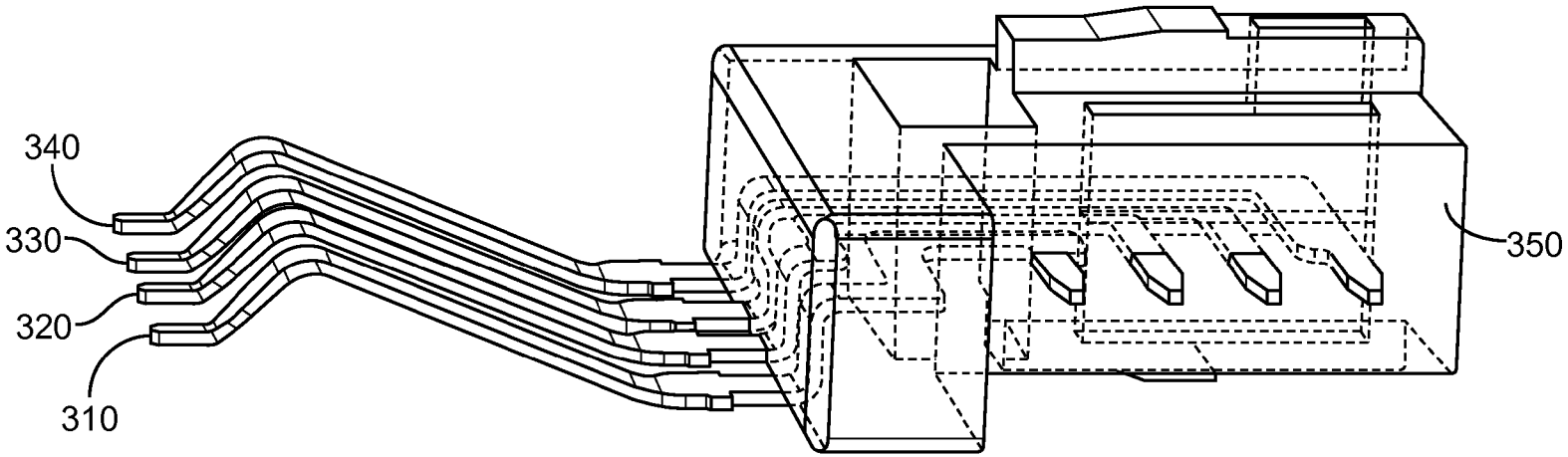
FIG. 5 illustrates a side view of contacts and a first housing portion according to an embodiment of the present invention.

FIG. 5 illustrates a side view of contacts 310, 320, 330, and 340, and first housing portion 350 according to an embodiment of the present invention.

Again, it may be desirable to provide a connector receptacle having a pleasing appearance. One way of achieving this may be to provide a housing for the connector receptacle that appears to be formed of a single piece of plastic or other material. An example of one way to do this is shown in the following figure.

Figure 6:
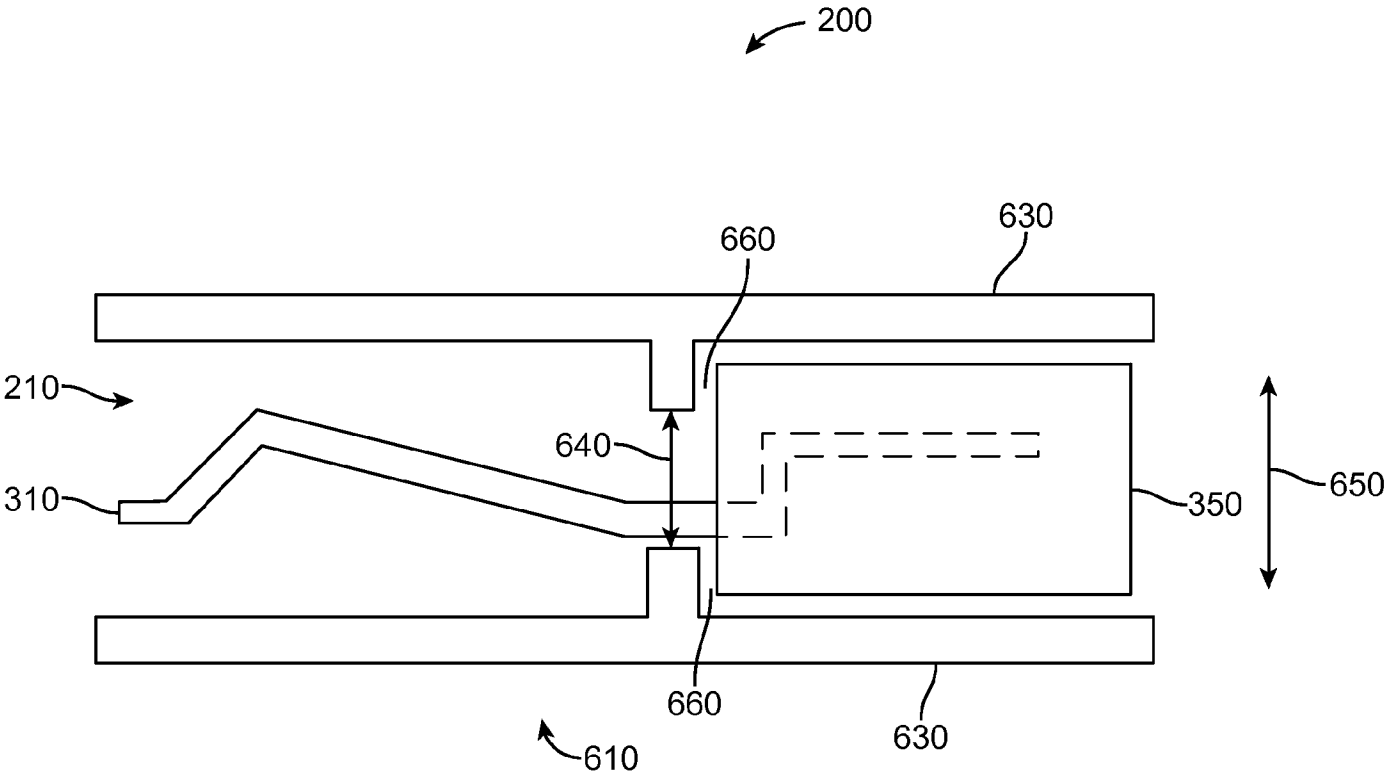
FIG. 6 illustrates a side view of contacts, a first housing portion, and a second housing portion of a connector receptacle according to an embodiment of the present invention.

FIG. 6 illustrates a side view of contacts 310, first housing portion 350, and second housing portion 630 for a connector receptacle according to an embodiment of the present invention. Once contacts 310 and first housing portion 350 are formed, they may be inserted in direction 610 into second housing 630. Second housing 630 may be an over-mold housing portion.

Second housing 630 may include opening 640, which may be wide enough to accommodate the insertion of contact 310. Opening 640 may be narrower than a thickness 650 of first housing portion 350. By sizing opening 640 in this way, contact 310 may be inserted through opening 640 into second housing portion 630, while second housing portion 350 may come flush against opening 640. With this assembly, as seen from opening 210, the housing of the connector receptacle 200 may appear as a single piece. In other embodiments of the present invention, some or all of second housing portion 630 may be formed, or integrated, with an enclosure surrounding some or all of an electronic device. In various embodiments of the present invention, glue or other adhesive may be placed in locations 660 to fix or attach first housing portion 350 to second housing portion 630. In other embodiments of the present invention, first housing portion 350 and second housing portion 630 may be shaped such that they may snap or otherwise securely fit together.

Figure 7:
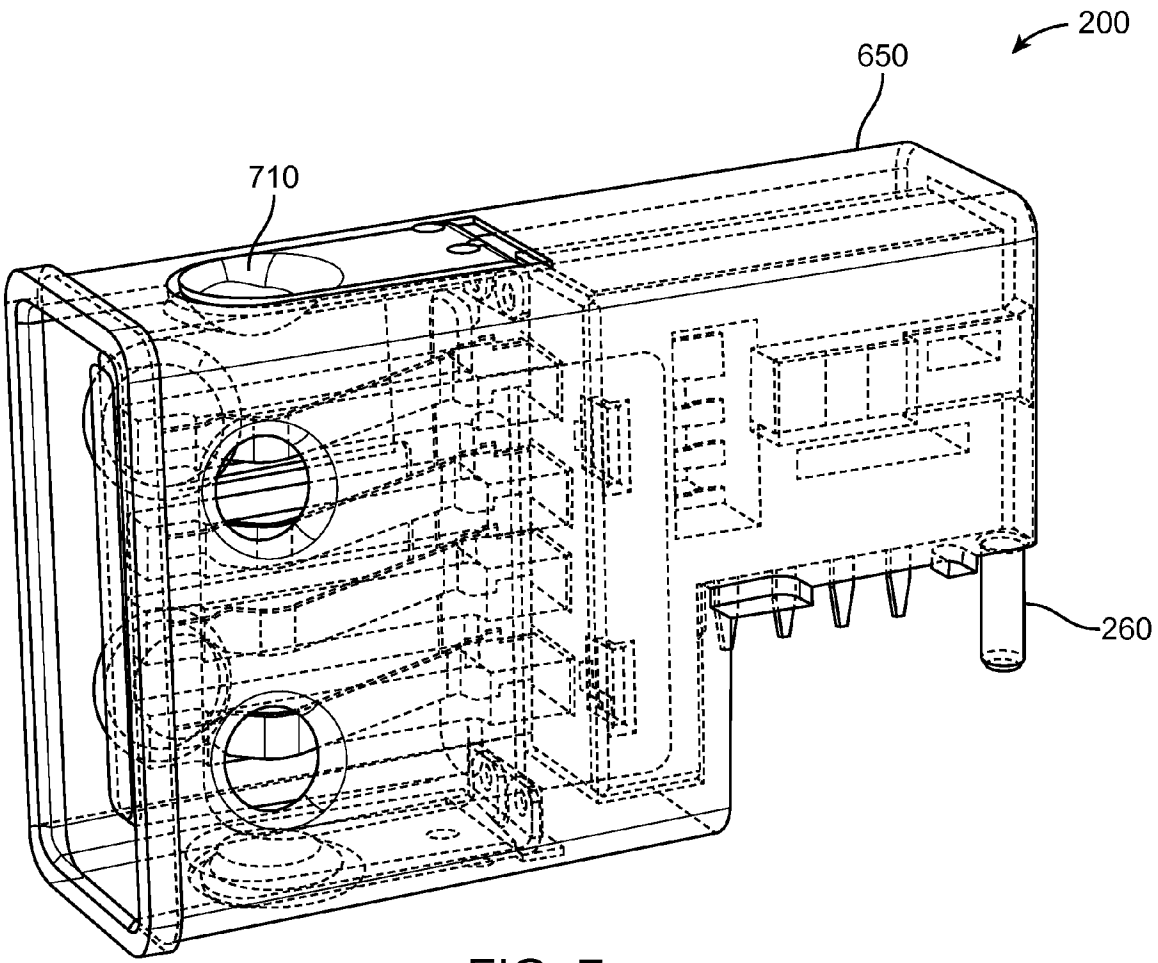
FIG. 7 illustrates a second housing portion or over-mold portion for a connector receptacle according to an embodiment of the present invention.

FIG. 7 illustrates a second housing portion, or over-mold portion, 650 for a connector receptacle according to an embodiment of the present invention. Again, second housing portion 650 may include one or more tabs 260. One or more tabs 260 may fit into corresponding holes in a main-logic board, or other appropriate substrate, to provide mechanical stability. One or more fingers 710 may be affixed to second housing portion 650. FIG. 710 may form electrical connections with a shield (not shown) around a connector insert, once such connector insert is inserted into connector receptacle 200.

Figure 8:
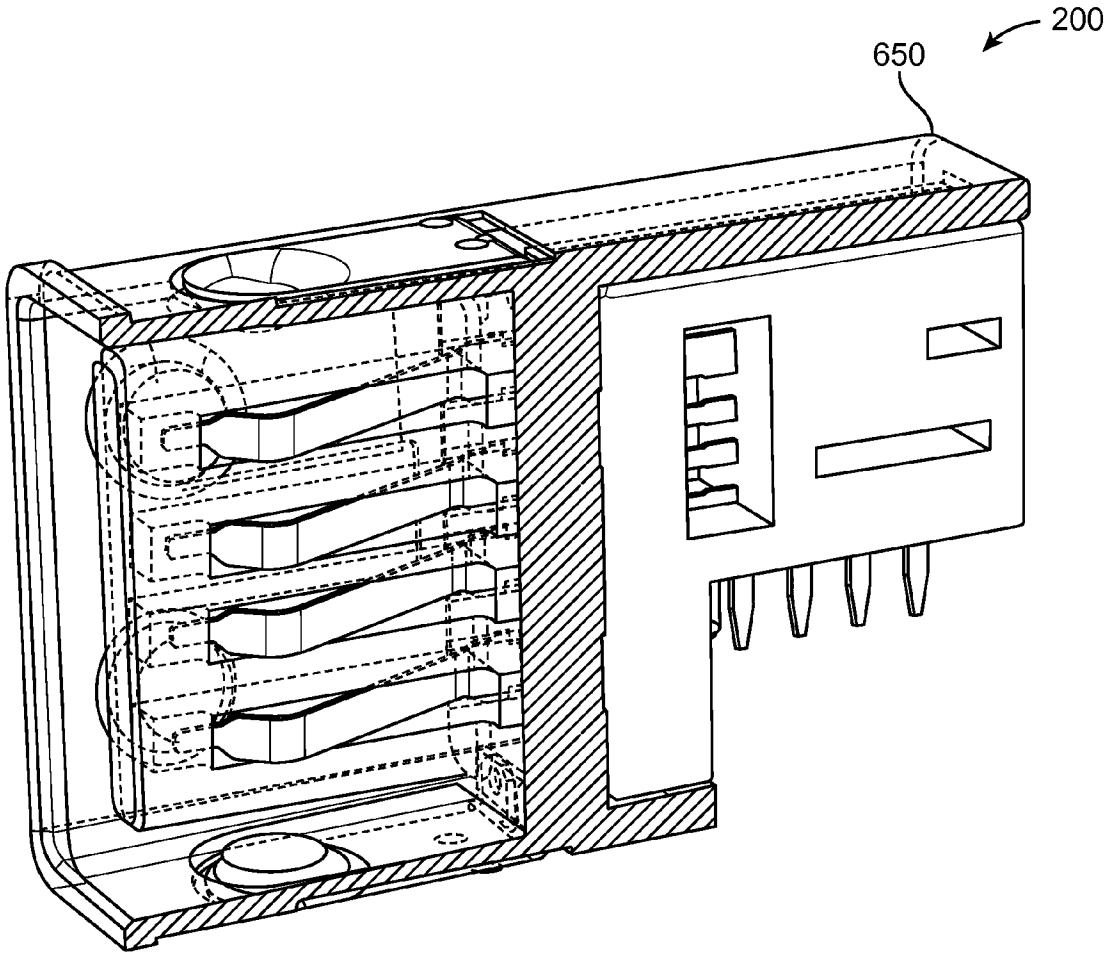
FIG. 8 illustrates a cut-away view of a second housing portion of a connector receptacle according to an embodiment of the present invention.

FIG. 8 illustrates a cut-away view of second housing portion 650 of connector receptacle 200 according to an embodiment of the present invention.

Again, embodiments of the present invention may provide a connector receptacle that is readily manufactured. In a specific embodiment of the present invention, manufacturability is improved by keeping one or more contacts together as a unit, as opposed to handling them on an individual basis. This and other embodiments of the present invention may also employ an over-mold, or second housing portion, that may accept a contact and insert mold, or first housing portion. An example of such a method is shown in the following figure.

Figure 9:
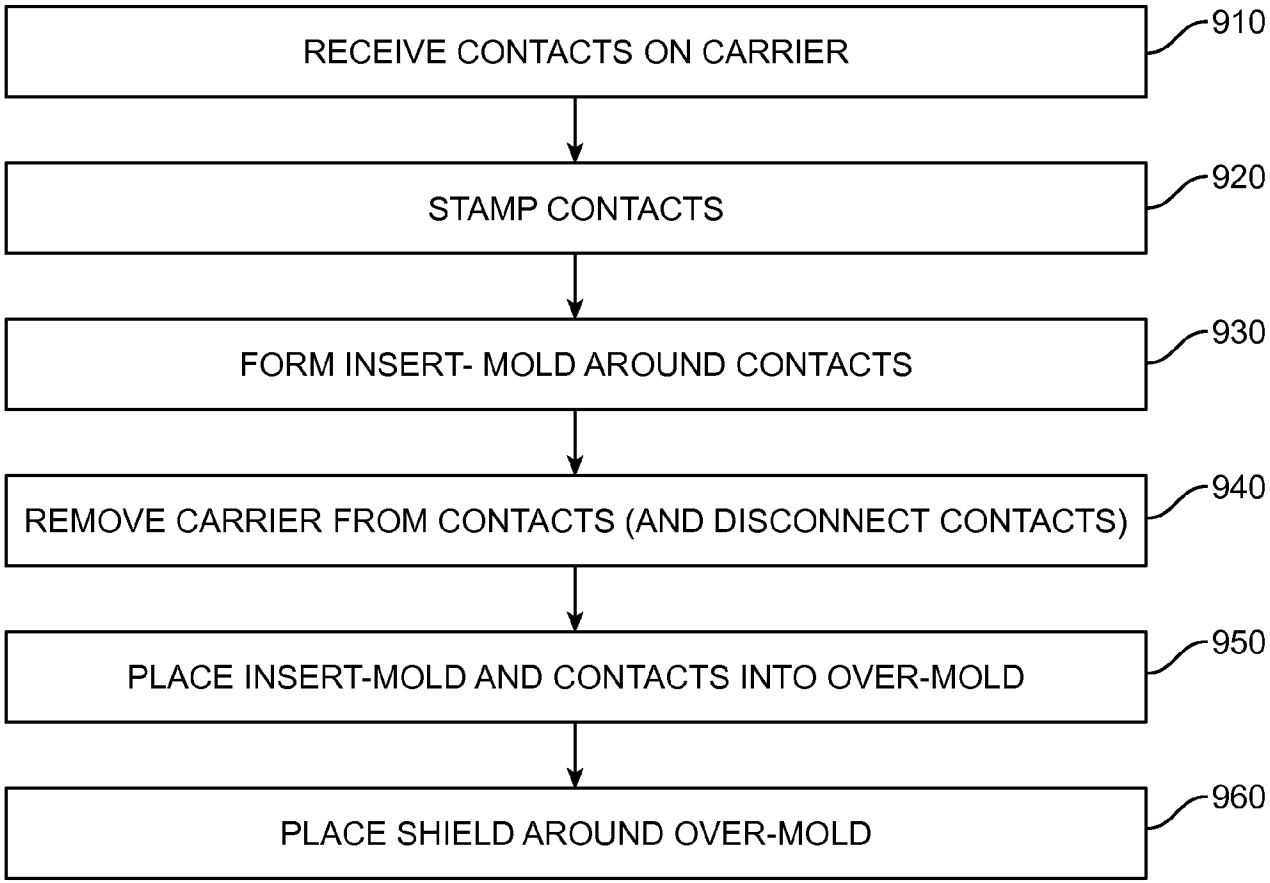
FIG. 9 illustrates a method of manufacturing a connector receptacle according to an embodiment of the present invention.

FIG. 9 illustrates a method of manufacturing a connector receptacle according to an embodiment of the present invention. In act 910, contacts are received. These contacts may be attached to a carrier. These contacts may also be bridged together to provide further mechanical support. In act 920, these contacts may be stamped then formed. An insert mold, or first housing portion, may be formed around a middle portion of the contacts in acts 930. In act 940, carriers and bridges may be removed from the contacts. The insert mold and contacts may be inserted into an over-mold, or second housing portion in act 950. A shield may be placed substantially around the over-mold in act 960.

Again, embodiments of the present invention may provide routing for a number of contacts to provide a right-angle translation in a space-efficient manner. An example of how this may be done is shown in the following figure.

Figure 10:
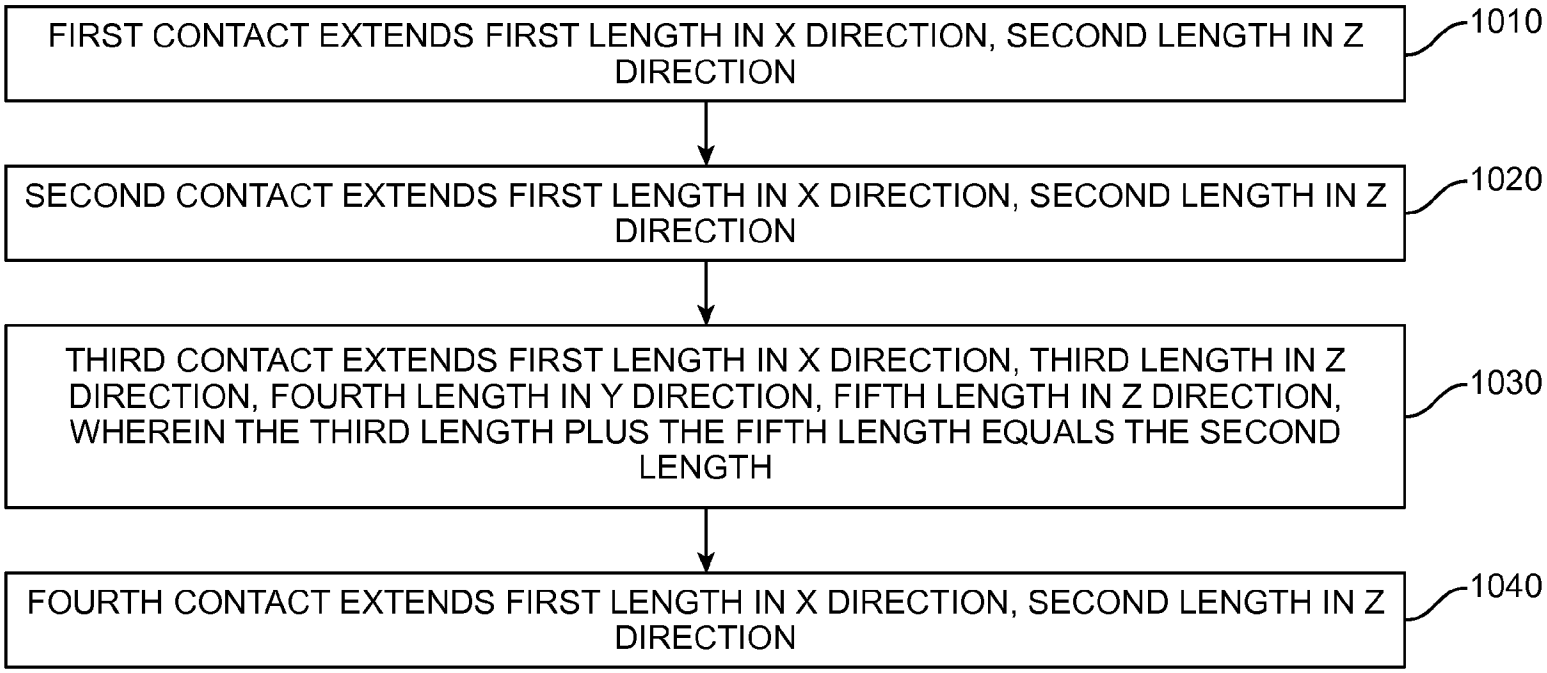
FIG. 10 illustrates an arrangement of contacts routed according to an embodiment of the present invention.

FIG. 10 illustrates an arrangement of contacts routed according to an embodiment of the present invention. In act 1010, a first contact extends a first length in an X direction and a second length in a Z direction. In act 1020, a second contact extends a first length in the X direction and a second length in the Z direction. In act 1030, a third contact extends a first length in the X direction, a third length in the Z direction, a fourth length in a Y direction, and a fifth length in the Z direction. The third length plus the fifth length may equal the second length. In act 1040, a fourth contact may extend a first length in the X direction and a second length in the Z direction.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A method of manufacturing a connector receptacle comprising:

receiving a plurality of contacts attached to a carrier, the plurality of contacts shaped to provide a right-angle translation;

forming the plurality of contacts;

molding a first housing portion around a middle portion of each of the plurality of contacts;

removing the carrier from the plurality of contacts;

inserting the contacts and first housing portion in an over-mold housing; and placing a shield substantially around the over-mold housing, wherein forming the plurality of contacts comprises forming the plurality of contacts such that:

a first contact extends approximately a first length in an X direction and approximately a second length in a Z direction;

a second contact extends approximately the first length in the X direction and approximately the second length in the Z direction; and a third contact extends approximately the first length in the X direction, approximately a third length in the Z direction, approximately a fourth length in a Y direction, and approximately a fifth length in the Z direction, wherein the third length plus the fifth length are approximately equal to the second length.

2. The method of claim 1 wherein forming the plurality of contacts further comprises forming the plurality of contacts such that:

a fourth contact extends approximately the first length in the X direction and approximately the second length in the Z direction.

3. The method of claim 2 wherein the first and fourth contacts are power contacts and the second and third contacts are data contacts for a Universal Serial Bus connector receptacle.

4. The method of claim 1 wherein the first housing portion is injection molded.

5. The method of claim 1 further comprising:

attaching the first housing portion to the over-mold housing.

6. The method of claim 5 wherein the first housing portion and the over-mold housing are glued together.

7. A method of manufacturing a connector receptacle comprising:

receiving a plurality of contacts attached to a carrier, the plurality of contacts shaped to provide a right-angle translation;

forming the plurality of contacts;

molding a first housing portion around a middle portion of each of the plurality of contacts;

removing the carrier from the plurality of contacts;

inserting the contacts and first housing portion in an over-mold housing; and placing a shield substantially around the over-mold housing, wherein the first housing portions includes a window located over a portion of each of the plurality of contacts, where each of the plurality of contacts are connected to a neighbor contact by one of a plurality of bridges.

8. The method of claim 7 further comprising:

removing the bridges connecting the plurality of contacts.

9. The method of claim 7 wherein the plurality of bridges are aligned with the window.

10. A method of manufacturing a connector receptacle comprising:

receiving a plurality of contacts attached to a carrier, the plurality of contacts shaped to provide a right-angle translation;

forming the plurality of contacts;

molding a first housing portion around a middle portion of each of the plurality of contacts;

removing the carrier from the plurality of contacts;

inserting the contacts and first housing portion in an over-mold housing;

placing a shield substantially around the over-mold housing; and attaching a plurality of fingers to the over-mold housing.

11. A connector receptacle comprising:

a plurality of contacts formed to provide a right-angle translation, wherein the plurality of contacts comprises:

a first contact extending approximately a first length in an X direction and approximately a second length in a Z direction;

a second contact extending approximately the first length in the X direction and approximately the second length in the Z direction; and a third contact extending approximately the first length in the X direction, approximately a third length in the Z direction, approximately a fourth length in a Y direction, and approximately a fifth length in the Z direction, wherein the third length plus the fifth length are approximately equal to the second length.

12. The connector receptacle of claim 11 further comprising:

a fourth contact extending approximately the first length in the X direction and approximately the second length in the Z direction.

13. The connector receptacle of claim 12 wherein the first and fourth contacts are power contacts and the second and third contacts are data contacts for a Universal Serial Bus connector receptacle.

14. The connector receptacle of claim 12 wherein portions of the first, second, third, and fourth contacts that extend approximately a first length in the X direction are arranged in the connector receptacle to form electrical connections with corresponding contacts in a corresponding connector insert.

15. A connector receptacle comprising:

a plurality of contacts formed to provide a right-angle translation;

a first housing formed around a middle portion of each of the plurality of contacts;

a second housing portion around the plurality of contacts and in contact with at least part of the first housing portion;

a plurality of fingers attached to the second housing portion; and a shield substantially around the second housing portion, wherein the plurality of contacts comprises:

a first contact extending approximately a first length in an X direction and approximately a second length in a Z direction;

a second contact extending approximately the first length in the X direction and approximately the second length in the Z direction; and a third contact extending approximately the first length in the X direction, approximately a third length in the Z direction, approximately a fourth length in a Y direction, and approximately a fifth length in the Z direction, wherein the third length plus the fifth length are approximately equal to the second length.

16. The connector receptacle of claim 15 wherein the plurality of contacts further comprises:

a fourth contact extending approximately the first length in the X direction and approximately the second length in the Z direction.

17. The connector receptacle of claim 16 wherein the first and fourth contacts are power contacts and the second and third contacts are data contacts for a Universal Serial Bus connector receptacle.

18. The connector receptacle of claim 15 wherein the first housing portion is formed by injection molding.

19. A connector receptacle comprising:

a plurality of contacts formed to provide a right-angle translation;

a first housing formed around a middle portion of each of the plurality of contacts;

a second housing portion around the plurality of contacts and in contact with at least part of the first housing portion;

a plurality of fingers attached to the second housing portion; and a shield substantially around the second housing portion, wherein the first housing portion and the second housing portion are formed such that they snap together.

20. The connector receptacle of claim 19 wherein the connector receptacle is a Universal Serial Bus connector receptacle.

* * * * *